US005258083A

United States Patent [19]

Monk et al.

[11] Patent Number: 5,258,083

[45] Date of Patent: Nov. 2, 1993

[54] METHOD FOR CONSTRUCTING AN OFFICE SPACE DIVIDING PANEL

[75] Inventors: Duane M. Monk; John R. Pfaendtner, both of Grand Rapids; Ronald B. DeLong, Belmont, all of Mich.

[73] Assignee: Westinghouse Electric Corp., Pittsburgh, Pa.

[21] Appl. No.: 915,042

[22] Filed: Jul. 15, 1992

Related U.S. Application Data

[63] Continuation of Ser. No. 599,529, Oct. 18, 1990, abandoned.

[51] Int. Cl.[5] ..... B32B 31/00; E04H 1/00

[52] U.S. Cl. ..... 156/64; 52/239; 156/212; 156/213; 156/216; 156/353; 156/355; 156/363; 156/480; 156/494; 160/135

[58] Field of Search ..... 156/363, 229, 216, 78, 156/212, 214, 351, 353, 354, 355, 64, 71, 479, 480, 494; 83/363, 76.7; 160/135; 52/222, 239; 427/208.2, 208.4

[56] References Cited

U.S. PATENT DOCUMENTS

| | | | |
|---|---|---|---|
| 3,531,347 | 9/1970 | Stultz, Jr. | 156/494 X |
| 3,762,116 | 10/1973 | Anderson et al. . | |
| 3,871,153 | 3/1975 | Birum, Jr. | 52/239 X |
| 4,059,714 | 11/1977 | Scholl et al. | 156/78 X |
| 4,259,402 | 3/1981 | Cobbs, Jr. et al. | 156/78 X |
| 4,296,579 | 10/1981 | Proud . | |
| 4,465,534 | 8/1984 | Zelkowitz | 156/212 X |
| 4,534,813 | 8/1985 | Williamson et al. | 156/212 |
| 4,571,906 | 2/1986 | Ashton . | |
| 4,635,418 | 1/1987 | Hobgood | 52/239 |
| 4,673,614 | 6/1987 | Wells et al. | 156/78 X |
| 4,722,146 | 2/1988 | Kemeny | 52/822 X |
| 4,851,070 | 7/1989 | Shimada | 156/212 X |
| 4,865,920 | 9/1989 | Sweet | 427/208.4 X |
| 4,949,518 | 8/1990 | Nagel et al. | 52/239 |
| 5,056,577 | 10/1991 | DeLong et al. . | |

OTHER PUBLICATIONS

Nordson Foam Melt 150 Series, 1988.
Nordson H-201, 1985.
H. B. Fuller Company, HL-1108, Jul. 1991.

*Primary Examiner*—Michael W. Ball
*Assistant Examiner*—Michele K. Yoder

[57] ABSTRACT

An office space dividing panel, and method of assembling same, wherein first and second rectangular fabric pieces are applied to first and second major flat faces, respectively, of a rectangular frame. The rectangular frame has a perimetrical edge which defines first and second peripheral grooves. Outer edges of the first and second fabric pieces are firmly held in the first and second peripheral grooves by a pressure sensitive adhesive, which in a preferred embodiment of the invention is applied to the grooves in a foamed, heated state. Each fabric piece is tensioned in the directions of the length and width of the fabric piece while the fabric is pressed into an adhesive coated peripheral groove, with sufficient pressure being applied during the pressing step to immediately set the adhesive and bond the fabric piece to the frame while retaining the applied tension in the fabric piece.

4 Claims, 5 Drawing Sheets

METHOD FOR CONSTRUCTING AN OFFICE SPACE DIVIDING PANEL

This application is a continuation of application Ser. No. 07/599,529 filed Oct. 18, 1990, abandoned.

TECHNICAL FIELD

The invention relates in general to open office space dividing systems, and more specifically to an office space dividing panel and method for constructing same.

BACKGROUND ART

Office space dividing systems are constructed of a plurality of office space dividing panels, which may be directly connected together in desired configurations, or interconnected via posts or other suitable connectors. U.S. Pat. No. 3,762,116, which is assigned to the same assignee as the present application, is an example of an office space dividing system which utilizes posts to support vertical edges of space dividing panels.

It is common to cover first and second major opposed flat sides of a rectangular space dividing panel with rectangular fabric pieces for sound absorption and esthetics. Each space dividing panel has an outer perimetrical edge which defines first and second substantially continuous peripheral spline grooves. During assembly of a space dividing panel, each fabric piece is manually placed on a major face of a space dividing panel and the edges of the fabric piece are held in the spline grooves by spline beads, similar to the attachment of a screen to a screen door. Application Ser. No. 07/523,772, filed May 15, 1990, now U.S. Pat. No. 5,056,577, entitled "Office Space Dividing System", which application is assigned to the same assignee as the present application, is an example of a space dividing panel which includes spline grooves and spline beads for holding fabric pieces on the outer surfaces of a substrate.

It takes a considerable amount of time and assembly skill on the part of an assembler to manually stretch a fabric piece and place a spline bead in a substantially continuous spline groove which extends about all four edges of a support frame, while maintaining desired tensions in X-Y frame and fabric directions, i.e., in the directions of the width and length (height) of the panel. Thus, the quality and appearance of the resulting panel depends upon the skill of the assembler, and the manufacturing cost of the panel includes manual fabric attachment time. It would be desirable, and it is an object of the present invention, to provide a new and improved space dividing panel, and new and improved methods for assembling space dividing panels, which enables fabric pieces to be automatically attached to a substrate or frame.

SUMMARY OF THE INVENTION

Briefly, the present invention includes a new and improved method of attaching fabric pieces to a substrate during the assembly of a space dividing panel. The new and improved method includes the step of providing a rectangular frame having first and second major flat sides which define predetermined length and width dimensions, an outer perimetrical edge extending between the first and second sides, and a substantially continuous peripheral groove in the outer edge for each fabric piece to be applied to the frame. In a preferred embodiment of the invention, the frame is on a conveyor and the length and width dimensions are automatically measured. This length and width information is then used by other automatic processes of the method.

A next step of the method includes providing a rectangular fabric piece which has length and width dimensions which exceed the length and width dimensions, respectively, of the rectangular frame. Since the size of the next frame coming along a conveyor is known from the frame measuring step of a preferred embodiment, the fabric piece may be automatically cut to size from a roll of fabric. Once the dimensions of the next frame to be processed are known, the dimensions of a rectangular fabric piece required to provide a desired uniform overlap of the fabric past the perimetrical edge of the frame can be determined.

While a frame is approaching a station where a fabric piece is to be applied, the step of placing a pressure sensitive adhesive in a peripheral groove of the frame is performed, i.e., in a peripheral groove which is associated with the side of the frame to be covered with the fabric piece. In a preferred embodiment, the pressure sensitive glue is sprayed into the groove by a robot holding an adhesive gun which moves about the perimeter of the frame.

In order to obtain a "soft" layer or bead of adhesive in the groove, economical usage of the adhesive, and the desired spraying consistency, the adhesive is heated and foamed with an inert gas prior to the spraying step. The "soft" bead of adhesive enables the fabric to be more easily pressed into the peripheral groove.

The method further includes the step of tensioning the fabric piece in the directions of the length and width of the fabric piece. It was found that an effective way of holding and tensioning the fabric was to insert a plurality of closely spaced, slanted needles into the four edges of the fabric piece, with needle bars employed to hold the needles being movable, such as via air or hydraulically operated cylinders, to simultaneously stretch and tension the fabric in both the length and width directions of the fabric piece.

The method then includes the step of automatically wrapping the tensioned fabric piece over the frame edges, while covering the first major side of the frame with the fabric piece. While the tensioned fabric piece is so held, a step of pressing the tensioned fabric piece into the substantially continuous peripheral groove is automatically performed by movable tucking bars which, for example, may be attached to air or hydraulic cylinders. The tucking bars advance towards the edges of the frame to press the fabric into the peripheral groove and against the layer or bead of adhesive. The resulting pressure of the fabric and tucking bar against the adhesive during this pressing step causes the pressure sensitive adhesive to immediately set, which results in the fabric being firmly bonded to and held in the peripheral groove notwithstanding the quick retraction of the tucking bars from the peripheral groove.

The frame is then manually or automatically turned over, and the hereinbefore recited method steps are repeated to apply a fabric piece to the remaining major side or face of the frame.

The method results in a new and improved space dividing panel, as the fabric pieces are consistently highly tensioned in both the length and width directions of the fabric piece, improving the appearance of the space dividing panel. The panel is further devoid of spline beads, which can dislodge from a spline groove and release the tension in the fabric. The adhesive consistently and continuously holds the fabric pieces in tension with no chance of mechanical dislodgement of the fabric pieces from the associated spline groove.

BRIEF DESCRIPTION OF THE DRAWINGS

The invention will become more apparent by reading the following detailed description in conjunction with the drawings which are shown by way of example only, wherein.

DESCRIPTION OF PREFERRED EMBODIMENTS

Figure 1:
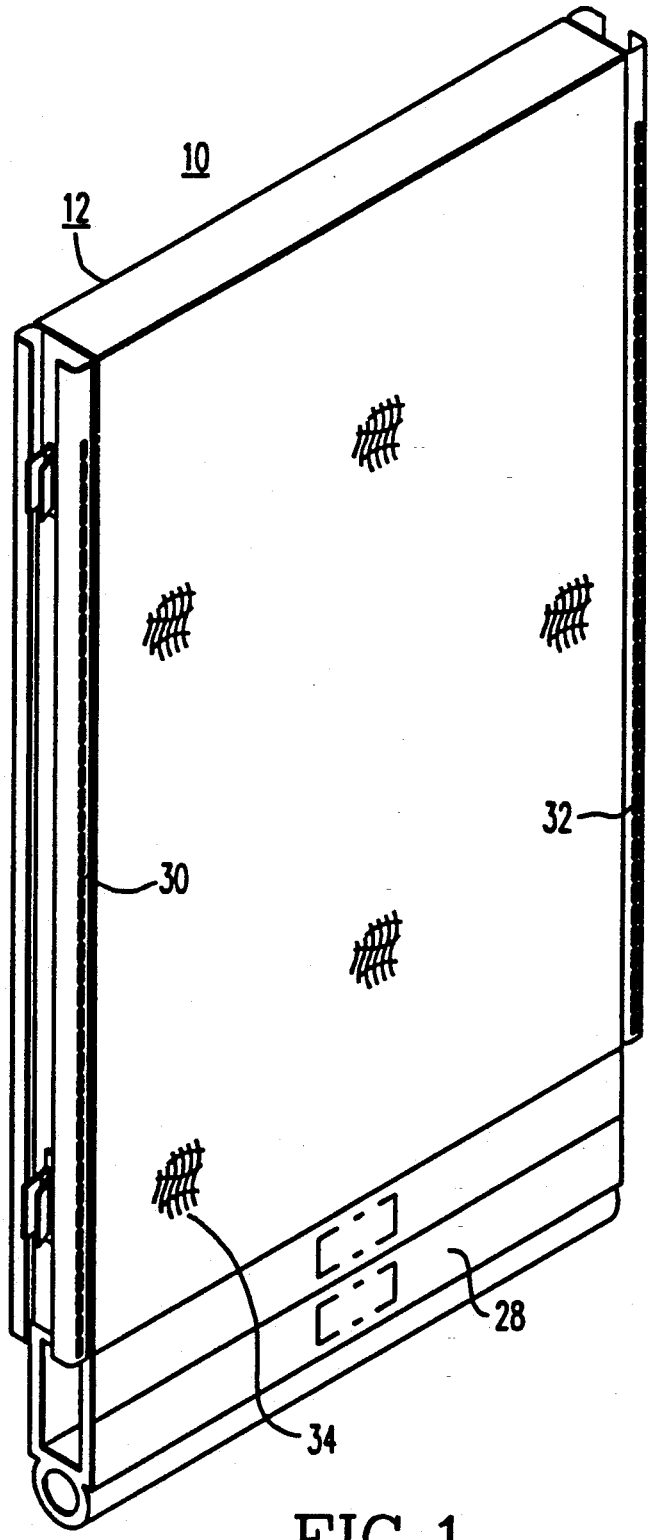
FIG. 1 is a perspective view of a space dividing panel which may be constructed according to the teachings of the invention.
Figure 2:
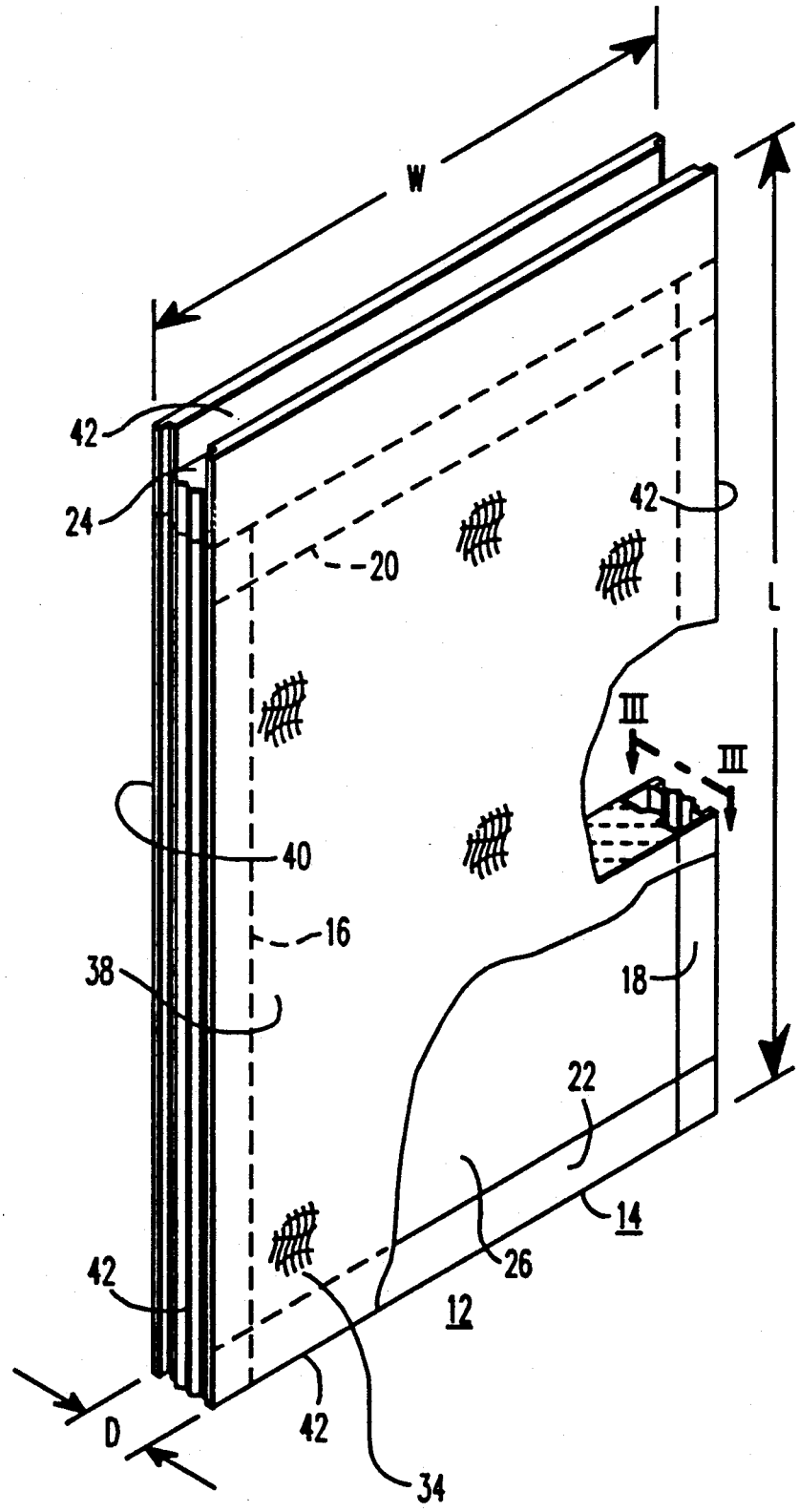
FIG. 2 is a view similar to FIG. 1, except illustrating a perspective view of only a panel frame with fabric pieces attached thereto, eliminating a raceway illustrated in FIG. 1, which is attached to the lower edge of the frame, as well as eliminating slotted standards and post connector hooks shown in FIG. 1 which are attached to vertical edges of the panel.

Referring now to the drawings, and to FIGS. 1 and 2 in particular, there is shown in FIG. 1 a space dividing panel 10 which may be constructed according to the teachings of the invention. Space dividing panel 10 includes a frame-fabric assembly 12, which is more clearly shown in FIG. 2. Remaining with FIG. 2, frame-fabric assembly 12 includes a rectangular frame 14 constructed of interconnected metallic rails and stiles, such as first and second vertical stiles 16 and 18 and upper and lower rails 20 and 22. One or more reinforcing cross rails (not shown) may be provided, as required by the dimensions of frame 14. The upper rail 20 may be at the top of the assembly 12, or, as illustrated, a wiring trough 24 may be mounted on the upper rail 20. In a preferred embodiment of the invention, the metallic frame 14 has a solid core 26, such as a solid gypsum core which has been foamed in place within the rails and stiles of the frame. U.S. Pat. application Ser. No. 06/872,053, filed June 6, 1986, now U.S. Pat. No. 4,949,518, entitled "Space Dividing Wall Panel", which is assigned to the same assignee as the present application describes space divider panels with foamed-in-place gypsum cores. However, other suitable frame-core arrangements may be used.

Figure 3:
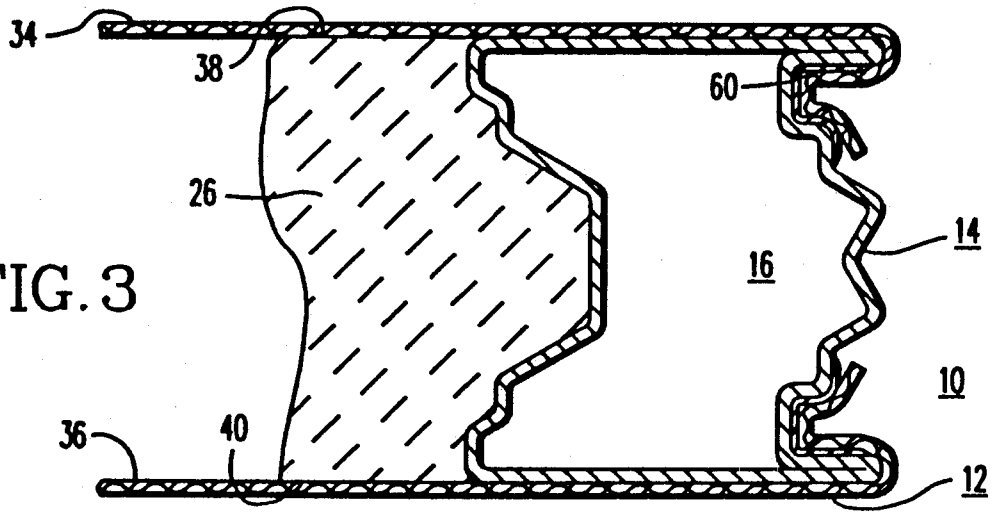
FIG. 3 is a fragmentary cross sectional view of the panel frame and fabric assembly shown in FIG. 2, taken between and in the direction of arrows III—III, illustrating the attachment of fabric pieces to the frame, along a frame stile.

Returning to FIG. 1, the space dividing panel 10 is completed by fastening a raceway 28 to the lower rail 22, fastening slotted standards 30 and 32 to the first and second stiles 16 and 18, and attaching first and second fabric pieces 34 and 36, shown in FIGS. 1 and 3, to the frame 14.

Frame 14, as shown in FIG. 2, has horizontal width W and vertical length L (height) dimensions, with the width dimension W, which is measured from the outer edge of stile 16 the outer edge of stile 18, normally being selected from a range of about 10 to 60 inches, and with the length dimension L, which is measured from the lower edge of bottom rail 22 to the top edge of the wiring trough 24, normally being selected from a range of about 36 to 76 inches. Frame 14 has a constant depth or thickness dimension D regardless of the width and length dimensions W and L, such as a thickness dimension in a range of about 1.5 to 3 inches.

Figure 4:
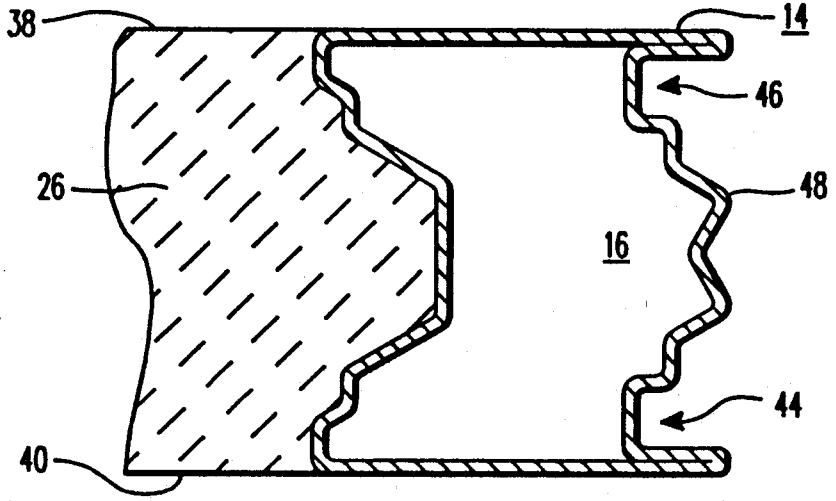
FIG. 4 is a fragmentary sectional view similar to that of FIG. 3, except it illustrates the frame before fabric pieces are attached thereto.

Frame 14 has first and second flat major opposed sides, faces or surfaces 38 and 40, best shown in FIG. 4, which are respectively covered by fabric pieces 34 and 36, as best shown in FIG. 3. Frame 14 has an outer perimetrical edge 42 which includes the horizontally oriented edges defined by wiring trough 24 and lower rail 22 and the vertically oriented edges defined by the first and second stiles 16 and 18.

FIG. 3 is a cross sectional view of frame 14, taken between and in the direction of arrows III—III in FIG. 2, illustrating the first stile 16. FIG. 4 is a view similar to FIG. 3, except illustrating frame 14 prior to application of fabric pieces 34 and 36. The outer facing side of stile 16, which is the side which forms part of the perimetrical edge 42 of frame 14, is formed into a configuration which includes first and second grooves 44 and 46 immediately adjacent to the flat major sides 38 and 40, respectively, of frame 14. An intermediate or bridging portion 48 is integrally joined to the sides of grooves 44 and 46. All of the rails and stiles have a like configuration. If a wiring trough 24 is used, the top of the wiring trough would also have two spaced grooves similar to grooves 44 and 46. In order to provide wire lay-in capability, the wiring trough 24 would not have an interconnecting or bridging portion 48 between the grooves 44 and 46, as shown for stile 16. Thus, the outer perimetrical edge 42 of frame 14 has first and second substantially continuous peripheral grooves 44 and 46, which extend about frame 14 closely adjacent to sides 38 and 40, respectively.

Figure 5:
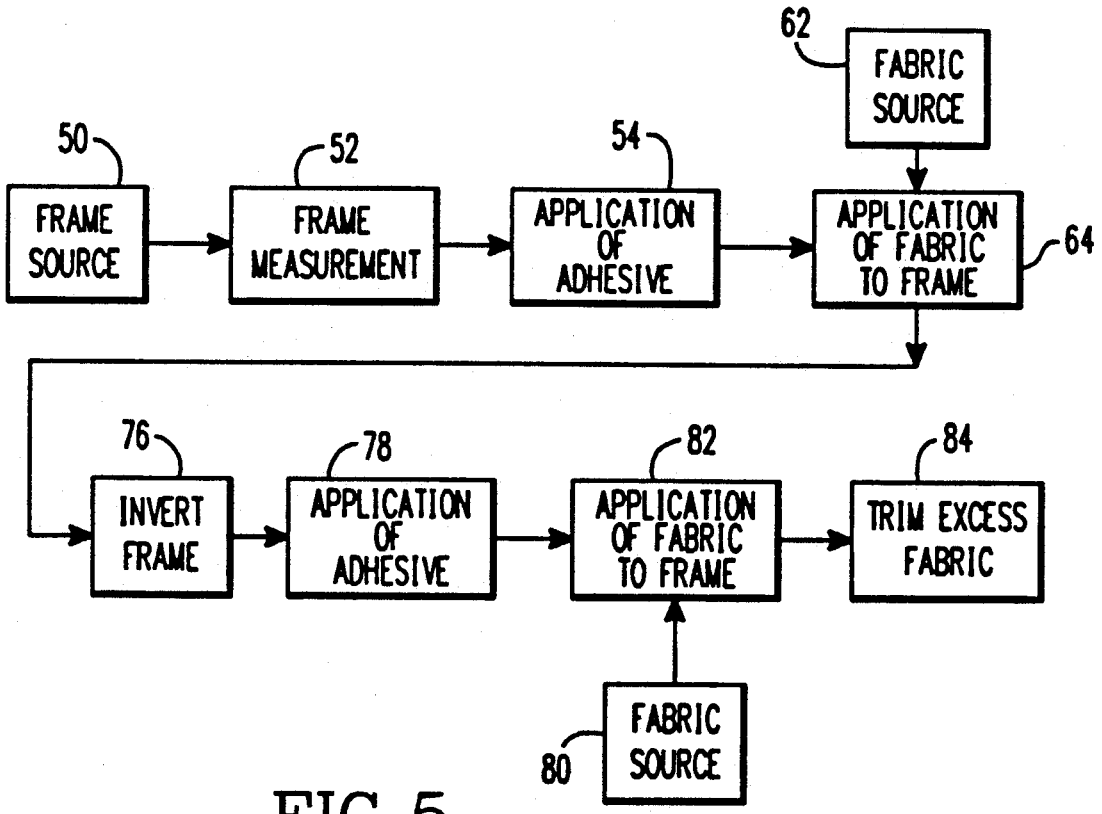
FIG. 5 is a block diagram which illustrates method steps of applying fabric pieces to a rectangular frame, according to the teachings of the invention.

FIG. 5 is a block diagram which illustrates a method of applying and attaching fabric pieces 34 and 36 to frame 14 according to the teachings of the invention. A source 50 of frames 14 provides one frame after another to the process, such as via a powered roller conveyor which serially brings frames 14 to the various stations which perform the steps of the method. When the frames 14 are constructed according to the teachings of the hereinbefore mentioned application Ser. No. 06/872,053, for example, the frames leaving the process which provides the foamed-in-place gypsum core may be the frame source 50.

Since the width and length dimensions W and L of the frame 14 may vary widely, such as in the hereinbefore stated dimensional ranges, in a preferred embodiment of the invention each frame 14 is automatically measured to obtain its width and length dimensions W and L so that the size of the frame 14 will be known by processing stations to which the frame will advance. In one embodiment of the measuring step, one of the frame dimensions, such as the width dimension W of frame 14, is detected as the frame moves along the conveyor. Conveyor speed and the time required for the frame to pass a sensor provides inputs required for a computer to calculate the width dimension W. Then, frame 14 is stopped at a frame measurement station, indicated at 52 in FIG. 5. At this station, a sensor wheel is moved along the length dimension of frame 14 by a drive motor. Revolutions of the sensor drive motor are counted and provided as an input to a process computer. The process computer then calculates the length dimension L from the known diameter of the sensor wheel.

Figure 6:
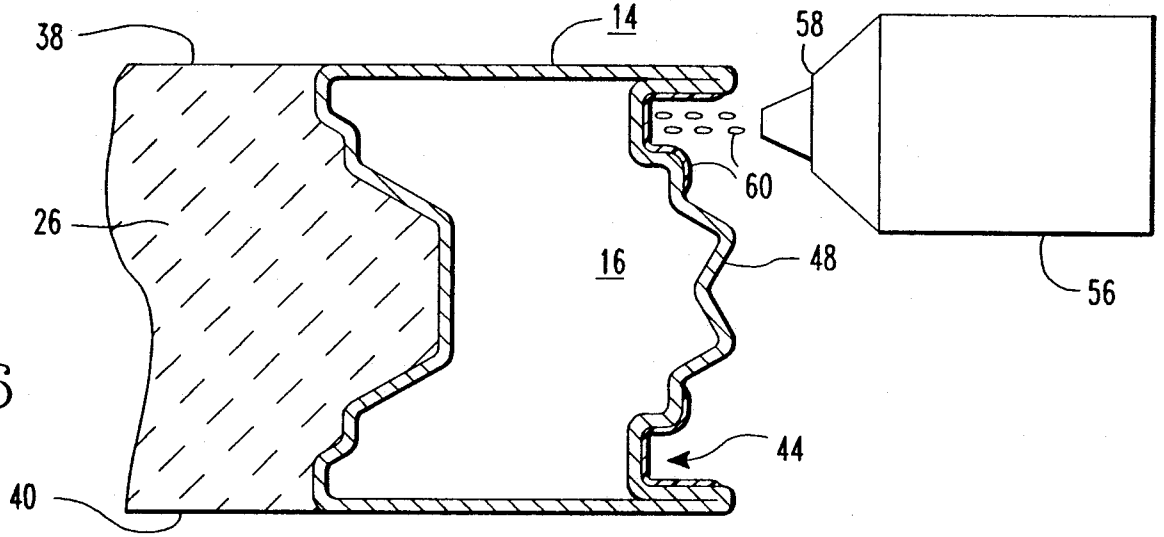
FIG. 6 is a fragmentary view similar to FIG. 4, illustrating a method step of applying an adhesive to a groove defined by the perimetrical edge of the frame.

After the measuring step 52, frame 14 advances to a station 54 where an adhesive is applied to the surface of one of the peripheral grooves 44 or 46. As illustrated in FIG. 6, in a preferred embodiment of the invention a robot 56 supports an adhesive gun 58 and the robot 56 traverses the perimeter of frame 14, spraying an adhesive 60 into a selected one of the peripheral grooves, such as peripheral groove 46. The travel path of robot 56 is automatically programmed using the frame size information obtained from the frame measuring step 52.

The adhesive 60 is a pressure sensitive adhesive selected such that it will bead and stand at room temperature for hours without setting, requiring pressure to activate the setting process. An adhesive or glue having the required characteristics is commercially available from the H. B. Fuller Company with their designation HL-1108.

Adhesive HL-1108 is a block styrene-butadiene thermoplastic rubber hot melt glue which is heated to a temperature of about 375 to 400 degrees F. prior to spraying. Also, in a preferred embodiment of the invention, the adhesive 60 is foamed with an inert gas, such as nitrogen, just prior to spraying. The foaming of the adhesive 60 provides the advantages of providing a "softer" strip or bead of adhesive, enabling fabric piece 34 to be more easily pressed into the peripheral groove 46. The foaming of the adhesive also enables the amount of adhesive applied to each frame 14 to be reduced, i.e., it provides increased adhesive mileage. Suitable hot melt processors which mix an inert gas with a hot adhesive, as well as suitable adhesive guns, are commercially available from Nordson Corporation, Norcross, Ga. A suitable hot melt-foam processor is Nordson Corporation's 150 Series Processor, and a suitable adhesive gun is Nordson Corporation's H-201 Zero Cavity Gun.

Fabric piece 34 is provided to the process by a fabric source 62. Fabric source 62, for example, may be a roll of fabric which is manually or automatically cut, using the size information obtained from the panel measuring step 52. Fabric piece 34 is cut into a rectangular configuration and sized such that it will completely cover major side 38 of frame 14 while uniformly overlapping all four sides of frame 14 by a predetermined dimension. The predetermined dimension is selected to provide sufficient fabric such that the fabric will enter the requisite peripheral groove and extend outwardly therefrom by a dimension sufficient for fabric pick-up apparatus to firmly hold the fabric piece 34 throughout fabric application steps indicated generally at 64. In a preferred embodiment of the invention, a laminated fabric having a resilient foam backing is used, such as a closed cell polyurethane foam, but other fabrics may be used. Suitable fabrics, including foam backed fabrics, are commercially available from Miliken Company, Guilford Company, and Burlington Company. After the fabric piece 34 is cut it is placed at a loading station associated with fabric source 62.

The next steps of the method, shown generally at 64, include a step of applying fabric piece 34 to frame 14. Fabric piece 34 is picked up at the loading station, on all four sides thereof, by a fixture or assembly 65 which also has four sides, automatically adjustable to the size of the frame 14 being processed. Assembly 65 includes a plurality of slanted needles 66 mounted on bars 68. The needles 66 engage fabric piece 34 close to the edges thereof. The needle bars 68 are mounted for rectilinear movement, such as by air or hydraulic cylinders 70. After the assembly 65 and needle bars 68 move down and engage fabric piece 34 on all four sides, needle bars 68 retract to stretch and tension fabric piece 34 in the directions of its width and length.

Figure 7:
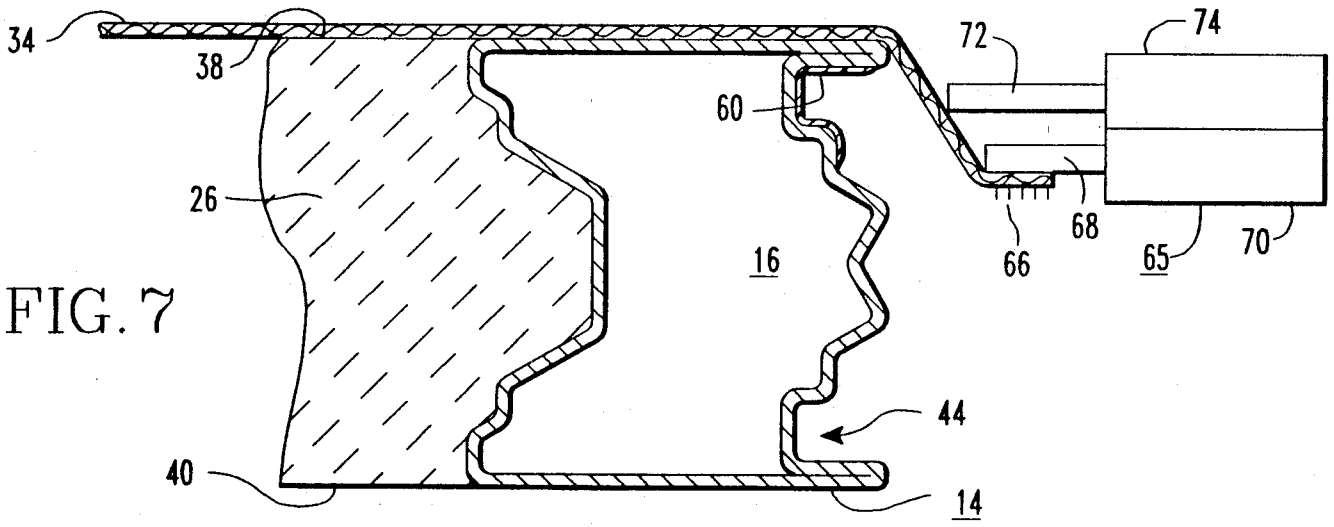
FIG. 7 is a fragmentary view similar to FIG. 6, illustrating a method step of wrapping a fabric piece over the perimetrical edge of the frame, as well as illustrating a tucking bar which performs a method step of pressing tensioned fabric into the peripheral groove to set the adhesive and hold the fabric firmly in the peripheral groove after the fabric piece is released by needle bars shown in FIG. 7.

The tensioned fabric piece 34 is then moved over frame 14 and downwardly to the position shown in FIG. 7, wrapping fabric piece 34 downwardly over the four perimetrical edges of frame 14. Assembly 65 further includes tucking bars 72 disposed on all four sides of assembly 65, with the tucking bars 72 being mounted for rectilinear movement, such as via air or hydraulic cylinders 74. After fabric piece 34 has been wrapped over the edges of frame 14, cylinders 74 advance the tucking bars 72 to press the fabric piece 34 firmly into peripheral groove 46 and against the pressure sensitive adhesive 60. The pressure sensitive adhesive 60 instantly sets in response to the pressure applied thereto, bonding and holding the fabric piece 34 tightly and uniformly in the desired position covering the flat major side 38 of frame 14. The pressing step performed by tucking bars 72 adds to the tension in the fabric piece 34, providing a tightly tensioned fabric covering over the frame face 38 which provides a pleasing appearance. The adhesive 60 maintains its holding strength indefinitely, and unlike the prior art use of spline beads, there is no danger of accidental local detachment of a spline bead and fabric from the frame, which detachment relaxes the tension in the fabric and creates wrinkles, or otherwise detracts from the appearance of a finished panel 10.

At this point of the process, excess fabric may be manually or automatically trimmed from the fabric piece 34, or the trimming step may be performed after both fabric pieces 34 and 36 have been applied, as desired.

After fabric piece 34 has been applied and securely bonded to frame 14, step 76 inverts or turns frame 14 over, and the hereinbefore described process is repeated to apply fabric piece 36 to cover flat major side 40 of frame 14. Step 78 applies hot, foamed pressure sensitive adhesive 60 to peripheral groove 44, step 80 cuts fabric piece 36 to the proper rectangular configuration and dimensions, step 82 applies and bonds fabric piece 36 to side 40 of frame 14, and step 84 trims excess fabric from both pieces 34 and 36, if piece 34 had not been previously trimmed, or only from piece 36 if piece 34 had been previously trimmed. FIG. 3 illustrates panel 10 after both fabric pieces 34 and 36 have been applied to frame 14 and trimmed.

In summary, there has been disclosed a new and improved method of applying fabric pieces 34 and 36 to a frame 14 during the assembly of a space dividing panel 10 for use in office space dividing furniture systems. The method eliminates manual attachment of fabric pieces to a frame via spline beads, and it provides a superior office space dividing panel 10 without reliance upon the skill of an assembler. The fabric pieces 34 and 36 are more highly tensioned than fabric pieces applied manually, and the fabric pieces 34 and 36 are permanently bonded to the metallic frame, eliminating accidental local dislodgement of a spline bead and fabric edges from spline grooves formed in the perimetrical edge of the frame.

What is claimed is:

1. A method of applying fabric to a frame of an office space dividing panel, comprising the steps of:

providing a rectangular frame having first and second major flat sides which define predetermined length and width dimensions, an outer perimetrical edge extending between the first and second sides, at least one substantially continuous peripheral groove in the outer edge, sensing the speed of the frame and sensing the time for the frame to pass a sensor thereby automatically measuring the frame, providing a rectangular fabric piece by automatically cutting the fabric piece in accordance with the dimensions determined by the automatic measuring of the frame, spraying a heated pressure sensitive adhesive in the at least one peripheral groove, engaging a plurality of needles to the fabric for tensioning the fabric piece in the directions of its length and width, wrapping the tensioned fabric piece over the edges of the frame, while covering the first major side of the frame with the fabric piece, and advancing tucking bars into contact with the fabric for pressing the tensioned fabric piece into the substantially continuous peripheral groove with sufficient pressure to set the adhesive.

2. The method according to claim 1 wherein the method further comprises moving a sensor wheel along the frame to determine the length of the frame.

3. The method according to claim 2 wherein the step of sensing the speed of the frame and sensing the time for the frame to pass a sensor determines the width of the frame.

4. The method of claim 3 wherein the step of placing a pressure sensitive adhesive includes foaming the pressure sensitive adhesive.

* * * * *